United States Patent [19]

Heinen

[11] 4,424,653

[45] Jan. 10, 1984

[54] FIRE-PROOF WINDOW

[76] Inventor: Hans-Dieter Heinen, rue Catherine André 15, 4890 Malmedy, Belgium

[21] Appl. No.: 215,058

[22] Filed: Dec. 10, 1980

[30] Foreign Application Priority Data

Oct. 10, 1980 [BE] Belgium ..... 202414

[51] Int. Cl.[3] ..... E06B 1/04

[52] U.S. Cl. ..... 52/213; 52/232; 52/400

[58] Field of Search ..... 52/232, 400, 213, 823, 52/217, 403

[56] References Cited

U.S. PATENT DOCUMENTS 1,614,318 1/1927 Ricken ..... 52/217

3,783,567 1/1974 Ollis ..... 52/232

4,178,728 12/1979 Ortmanns et al. ..... 52/232

*Primary Examiner*—Carl D. Friedman

*Attorney, Agent, or Firm*—Hill, Van Santen, Steadman & Simpson

[57] ABSTRACT

A fire-proof window in which the edges of the glass pane are sealed by means of a sealing joint in a continuous, heat-insulating frame. A rigid element made of heat-insulating material extends over the entire length of each groove of the casing and can be adjusted in its position relative to the base of this groove. As a result, when this fire-proof window is installed on the building site, the frame can be mounted with a slight clearance between the rigid elements after they have previously been adjusted and before the grooves are laterally closed off.

2 Claims, 3 Drawing Figures

FIRE-PROOF WINDOW

BACKGROUND OF THE INVENTION

This invention relates to a fire-proof window comprising a single or double pane the edges of which, surrounded by a suitable sealing joint, are housed in grooves provided by a casing.

In known fire-proof windows, the glass is mounted directly in a groove of the casing, said groove being open on one side for this purpose. Then this pane is sealed by means of the sealing joint in the groove which has previously been closed off, for example by means of a window batten mounted on the casing.

When a window of this kind is fitted on the building site, first the casing is placed in the corresponding opening in the masonry and fixed thereto. Then the glass is positioned in the opening in the casing and sealed in the grooves provided in the latter.

During manufacture, it sometimes happens that the casing is not strictly right-angled, particularly in its large dimensions. It may be that the manufacturing tolerances of the casing are exceeded. Moreover, it may happen that the casing moves out of true when mounted in the masonry. In both cases, the opening defined by the bases of the grooves of the casing is out of true and takes on the approximate shape of a parallelogram or a trapezium instead of its normal rectangular form. In such cases, after the glass has been placed in the opening in question, the edges of the glass are not at a regular spacing from the base of the grooves, and the sealing joint is thicker at certain points on the perimeter of the glass. These points are weak points from the point of view of fire-proofing, since they permit the rapid passage of flames and hot gases in the case of fire.

SUMMARY OF THE INVENTION

The object of the invention is a new fire-proof window which remedies the abovementioned disadvantages of known windows.

For this purpose, in the fire-proof window according to the invention, the edges of the glass are sealed by means of the sealing joint in a continuous, heat-insulating frame. Moreover, a rigid element made of heat-insulating material extends over the entire length of each groove of the casing and can be adjusted in its position relative to the base of this groove. As a result, when this fire-proof window is installed on the building site, the frame can be mounted with a slight clearance between the rigid elements after they have previously been adjusted and before the grooves are laterally closed off.

Thus, the assembling of the glass and the frame in the factory makes it possible for a uniform sealing joint with no weak points or zones to be provided between them. Moreover, the installation of the frame in the grooves of the casing on the building site means that a particularly small clearance can be obtained between this frame and the rigid elements of the grooves, which creates a very high loss of charge for any excape of gas. Consequently, the window according to the invention has fire-proof characteristics which are both considerable and easily reproducible, whatever the actual dimensions of the opening provided for the casing in the masonry, and irrespective of the manufacturing tolerances of this casing. Preferably, the frame of the pane of glass is made of synthetic material.

According to an advantageous feature of the invention, a tongue of expandable material is continuously provided between the base of the frame and the sealing joint. Owing to the nature of its constituent material, the tongue swells up under the effect of an increase in temperature and partially remedies the loss of seal of the joint when the latter is reduced in size by the action of the flames.

To permit easy adjustment of each rigid element relative to the base of the corresponding groove in the casing, the rigid element is mounted on the base of the corresponding groove of the casing by means of fixing screws and with an interposed flexible elastic element which is compressed over the entire length of the groove.

If the casing comprises a metal section which internally defines the opening of this casing, the section comprises the grooves and forms, on one side of said grooves, a continuous jamb acting as a support for the frame, and on the opposite side, an engagement opening for this frame, this opening being provided, after mounting, with a window batten acting as a support opposite said frame.

Other details and features of the invention will become apparent from the following description, which refers to the accompanying drawings.

DESCRIPTION OF EXEMPLARY EMBODIMENTS

Figure 1:
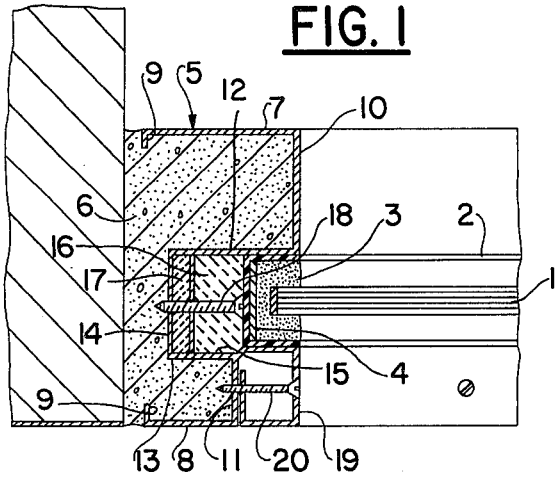
FIG. 1 is a partial horizontal section through a first embodiment of a fire-proof window according to the invention.

In the drawings, reference numeral 1 denotes a window pane of laminated glass which is, in particular, resistant to thermal shock. The pane 1 could be made of the same glass with double walls. The vertical and horizontal edges of the pane 1 are sealed in a continuous vertical frame 2 by means of a sealing joint 3. The frame 2 advantageously consists of identical U-shaped sections made of synthetic material. The ends of the sections are integral with one another. The inwardly directed flaps of the sections are respectively located in two planes parallel to the glass 1. The continuous joint 3 surrounds the edges of the glass 1 inside the frame 2. The joint 3, which is known per se, consists of synthetic material, based on silicone, for example.

Advantageously, a continuous tongue 4 is applied against the cores of the sections of the frame 2 over the entire periphery of the latter. Thus, the tongue 4 is in fact inserted between the joint 3 and the base of the frame 2. The tongue 4 is made of an expandable material, known per se, such as sodium silicate, for example. The advantage of the tongue 4 is as follows. In the case of a fire on one side of the fire-proof window, the joint 3, the frame 2 and the tongue 4 receive increasing heat and their temperature rises. Furthermore, the joint 3 is burned and progressively reduced by the flames. However, as the joint 3 is reduced, the tongue 4, becoming hotter and hotter, swells up in the frame 2 and reaches the edges of the pane 1 so as to at least temporarily remedy, to a greater or lesser extent the loss of seal along these edges, caused by the elimination of the synthetic material of the joint 3.

The fire-proof window is completed by a casing 5 housed in an opening in the masonry 6 and made integral with the latter in a manner known per se. In the first example shown (FIG. 1), the casing 5 comprises a metal section consisting, for example, of a steel sheet folded several times in the longitudinal direction. The section of the casing 5 is applied against the masonry 6 and also covers the latter. The section in question consists of two outer flaps 7 and 8 each provided with an edge 9, of two cores 10 and 11, two inner flaps 12 and 13 and a base 14. The flaps 7, 8, 12 and 13 are parallel to one another and perpendicular to the cores 10 and 11 and the base 14. The outer flaps 7 and 8 are anchored in the masonry 6 by their edges 9 which are embedded therein. The outer flap 7, the core 10 and the inner flap 12 form a continuous jamb. The outer flap 8, the core 11 and the inner flap 13 form a continuous shoulder which is, for example, shorter and narrower than the jamb. The inner flaps 12 and 13 and the base 14 define a longitudinal groove 15 opposite which is located the frame 2.

A hard, rigid element 16 is mounted in each groove 15 so as to be adjustable relative to the base 14. The rigid element 16 extends over the entire length and the entire width of the groove 15. The rigid element 16 is in fact a flat piece of heat insulating material, such as compressed asbestos-cement or the like. Between the base 14 and the rigid element 16 there is a soft, flexible, elastic element 17. This element 17 is in fact a strip of a preferably heat-insulating material, more particularly a wadding, consisting of asbestos foam, for example. The rigid element 16 is mounted on the section of the casing 5 and, more precisely, on the base 14 of the groove 15, by means of self-tapping adjusting screws 18. The clamping of the rigid element 16 by the screws 18 produces the compression of the flexible elastic element 17. Thus, after a predetermined degree of tightening of the screws 18, the rigid element 16 is selectively positioned in the groove 15 and held in position by the elastic counter-pressure of the flexible elastic element 17 in its compressed state.

The frame 2 engages without play between the rigid elements 16, is applied against the abovementioned jamb and held in place by window battens 19. Here, each window batten 19 is fixed to the shoulder by means of self-tapping fixing screws 20.

The fire-proof window is assembled as follows. In the factory, the glass 1 is mounted in the frame 2 provided with the tongue 4 and is sealed by means of the sealing joint 3. On the buiding site, the casing 5 is mounted in the corresponding opening in the masonry 6 and sealed therein. Then the position of the rigid elements 16 is adjusted relative to the bases 14 of the grooves 15, as a function of the dimensions of the frame 2 and so as to align them at right angles to one another. The frame 2 is engaged through the opening defined by the shoulders of the casing 5 and is introduced, without play, between the rigid elements 16 until it abuts on the jambs of this casing 5. Finally, the window battens 19 are mounted on the shoulders.

If there is a fire inside the building, i.e. on the core side 10 relative to the plane of the glass 1, the flames, smoke and burning gases are unable to flow between the frame 2, on the one hand, and the inner flaps 12 and the rigid elements 16, on the other hand, owing to the negligible play existing there which is due particularly to the possibility of adjusting these rigid elements 16. The flames also attack the joint 3 and burn it up but at the same time the tongue 4, whose temperature is increasing, progressively fills the inside of the groove in the frame 2. Thus, the tongue 4 replaces the joint 3 so as to temporarily prolong the seal between the frame 2 and the glass 1. As a result, the flames, smoke and hot gases are held inside the building for a relatively long time and cannot pass through the window, which is thus guaranteed fire-proof.

Figure 2:
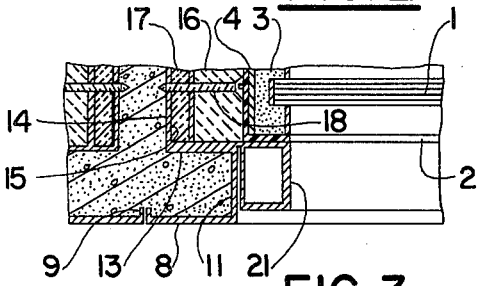
FIG. 2 is a partial horizontal section through a second embodiment of the new fire-proof window.

The second example shown (FIG. 2) differs from the first only in that the window battens 21 are clipped between the shoulders of the casing 5 and the rigid elements 16 in the grooves 15 instead of being fixed by means of clamping screws.

Figure 3:
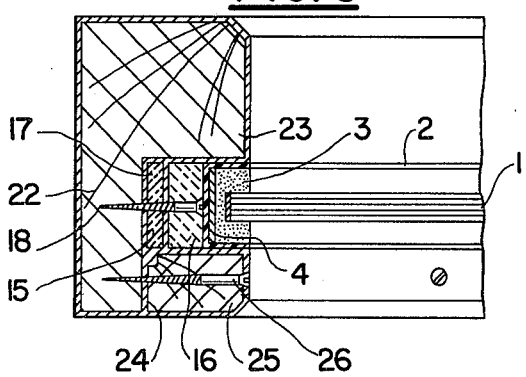
FIG. 3 is a partial sectional view of a third embodiment of the new window, with a casing which is substantially different from the preceding ones.

In the third example shown (FIG. 3) the casing is a wooden frame 22 having a jamb 23 and a wedge-shaped notch 24. Each notch 24 is closed off on the side opposite the jamb 23 by a wooden batten 25 fixed by means of wood screws 26 so as to define the groove 15 in which the flexible elastic element 17, the rigid element 16 and the frame 2 are also housed, as in the other two examples.

It should be noted that, in the case of a fire, the tongue of expandable material can expand almost freely on the side of the casing 5 owing to the presence of the compressible element 17, thus increasing the efficacy of the expandable material.

Obviously, the invention is not limited exclusively to the embodiment shown, and modifications may be made to the form, arrangement and construction of some of the elements used in these embodiments, without going beyond the scope of the present invention.

What is claimed is:

1. A fire-proof window comprising: a frame of U-shaped section forming an inner continuous groove, a pane of glass in said inner continuous groove, means sealing said pane in said inner continuous groove providing a sealing joint, tongue means made of a heat-expandable material placed in said inner continuous groove between the base of said inner continuous groove and the sealing joint so as to enable it to swell up and replace the sealing joint as the latter burns and reduces when heated under the effect of fire, thereby to keep the fire-proofing properties of the window, a casing formed with an inner longitudinal groove to accommodate said frame, a flexible elastic element placed against the bottom of said inner longitudinal groove over the entire length thereof, a rigid element made of heat-insulating material extending on and along said flexible elastic element and extending along the periphery of the frame, and adjustable clamping means to adjustably compress the flexible elastic element so as to properly and tightly position the frame within the casing.

2. A fire-proof window according to claim 1, wherein the casing has its inner longitudinal groove forming a continuous jamb for supporting the frame on one side of the window, a continuous shoulder, an window batten means fixed to the continuous shoulder to secure the frame in abutment with the jamb.

* * * * *